US010286541B2

(12) United States Patent
Huang

(10) Patent No.: US 10,286,541 B2
(45) Date of Patent: May 14, 2019

(54) TOOLBOX

(71) Applicant: HUNG TAI PACKING DESIGN CO., LTD., Kaohsiung (TW)

(72) Inventor: Shou-Chi Huang, Kaohsiung (TW)

(73) Assignee: Hung Tai Packing Design Co., Ltd., Kaohsiung (TW)

( * ) Notice: Subject to any disclaimer, the term of this patent is extended or adjusted under 35 U.S.C. 154(b) by 17 days.

(21) Appl. No.: 15/643,740

(22) Filed: Jul. 7, 2017

(65) Prior Publication Data

US 2019/0009403 A1 Jan. 10, 2019

(51) Int. Cl.

*B25H 3/02* (2006.01)
*B65D 21/02* (2006.01)
*B65D 43/16* (2006.01)

(52) U.S. Cl.

CPC ..... *B25H 3/022* (2013.01); *B65D 21/023* (2013.01); *B65D 21/0219* (2013.01); *B65D 43/16* (2013.01)

(58) Field of Classification Search

CPC .. B65D 21/023; B65D 21/0219; B25H 3/021; B23H 3/022
USPC ..... 206/372, 349, 382, 373
See application file for complete search history.

(56) References Cited

U.S. PATENT DOCUMENTS 4,593,816 A * 6/1986 Langenbeck ..... B65D 25/06 206/425
2006/0070900 A1* 4/2006 Brunson ..... B25H 3/003 206/373
2013/0118938 A1* 5/2013 Huang ..... B25H 3/00 206/372

FOREIGN PATENT DOCUMENTS

TW M478591 U 5/2014

* cited by examiner

*Primary Examiner* — Anthony D Stashick
*Assistant Examiner* — Raven Collins
(74) *Attorney, Agent, or Firm* — Rosenberg, Klein & Lee

(57) ABSTRACT

A toolbox is disclosed, comprising a case having two shells, wherein one of the two shells is formed with several strips which are crossed at right angles, and several containers put in the case and formed with several notches at a bottom edge of a body of the container to engage with the strips of the shell for positioning the container. Therefore, the containers can be put at any position in the toolbox by corresponding the strips which are crossed at right angles at the shell to the notches at the container's bottom, increasing the convenience of the positioning of the containers. Besides, when the containers are stacked with each other, the notches at the outer bottom of the body of the upper container is engaged with pegs on the lid of the lower container for positioning, thereby increasing the stability in the stacked condition.

2 Claims, 5 Drawing Sheets

TOOLBOX

BACKGROUND OF THE INVENTION

Field of the Invention

The present invention relates to a toolbox structure. More particularly, the toolbox structure makes convenient positioning the several containers in the toolbox and increase the stability when the containers are stacked.

Description of Related Art

The general toolbox is formed by two corresponding shells, which are pivoted with each other at one side and joined together at the other side. The inside of the toolbox is formed several cavities separated by the partitions for storing the components such as the screws, the nuts, the iron nails, and the rivets. Although the components are stored according to the classification, the separation effect of the partitions is not well so that the components are dropped out due to the shake when the toolbox is moved, causing the components disperse in the toolbox and not easy to find out the necessary component when the user works. Besides, the general toolbox is only provided the components to store, but the components needed in each work are not exactly the same, the user needs to take out the unnecessary components first, and then to put the necessary components, causing inconvenience in use.

Therefore, the inventor invented a toolbox structure in TW Patent with the Issue No. M478591U. The toolbox structure comprises a first shell formed with several pairs of protrusions, a second shell pivoted on the first shell, and several containers. Each container comprises a positioning part at the central bottom for corresponding to the protrusion of the first shell. By the design of the toolbox structure disclosed in the TW Patent with the Issue No. M478591U, it avoids the situation that the components in the toolbox are moved randomly when the user carries the toolbox. Furthermore, according to the needs in the each work, the container storing the needed components is chosen to put into the toolbox, increasing the convenience for toolbox arrangement. However, in the toolbox structure disclosed in the TW Patent with the Issue No. M478591U, the first shell is formed with several pairs of protrusions inside, and the bottom of each container is formed with a protruding positioning part for inserting between one pair of the protrusions to position the container. In use the foregoing toolbox structure, it is notice that the positioning part of the container only can be corresponded to the protrusions in the vacant area of the first shell, and then the positioning part of the container can be put and positioned between the protrusions in the vacant area of the first shell, causing inconvenience in use. Besides, in order to convenient to take out the components, the user usually takes the containers out and stacks them up, but the toolbox structure, disclosed in the TW Patent with the Issue No. M478591U, lacks the design for stacking the containers to result that the stacked containers are fallen down easily, also causing inconvenience in use.

SUMMARY OF THE INVENTION

Accordingly, the object of the present invention is to provide a toolbox structure, making convenient positioning the several containers in the toolbox and increase the stability when the containers are stacked.

For the above object, a toolbox comprises a case and several containers. The case comprises two shells pivotally connected with each other at one side to form a space inside. One of the two shells is formed with several strips which are crossed at right angles on an inner bottom of its cavity. The several containers are put in the space formed by the two shells. Each container comprises a body, a lid covered an opening of the body, a rib surrounded around a bottom edge of the body, and several notches formed in the rib to engage with the strips at the inner bottom of the cavity of one of the two shells for positioning the container.

According to an embodiment of the present invention, a top surface of the lid of each container is formed with an indentation, and a plurality of pegs are formed at sidewalls of the indentation, thereby putting anyone of the containers in the indentation in the top surface of the lid of another one of the containers, and the pegs at the lid of the lower container engaging with the notches in a bottom edge of the upper container.

Therefore, the containers can be put at any position in the toolbox by corresponding the strips which are crossed at right angles at the shell to the notches at the container's bottom, increasing the convenience of the positioning of the containers. Besides, when the containers are stacked with each other, the notches at the outer bottom of the body of the upper container is engaged with the pegs on the lid of the lower container for positioning, thereby increasing the stability in the stacked condition.

DETAILED DESCRIPTION OF THE PREFERRED EMBODIMENT

Figure 1:
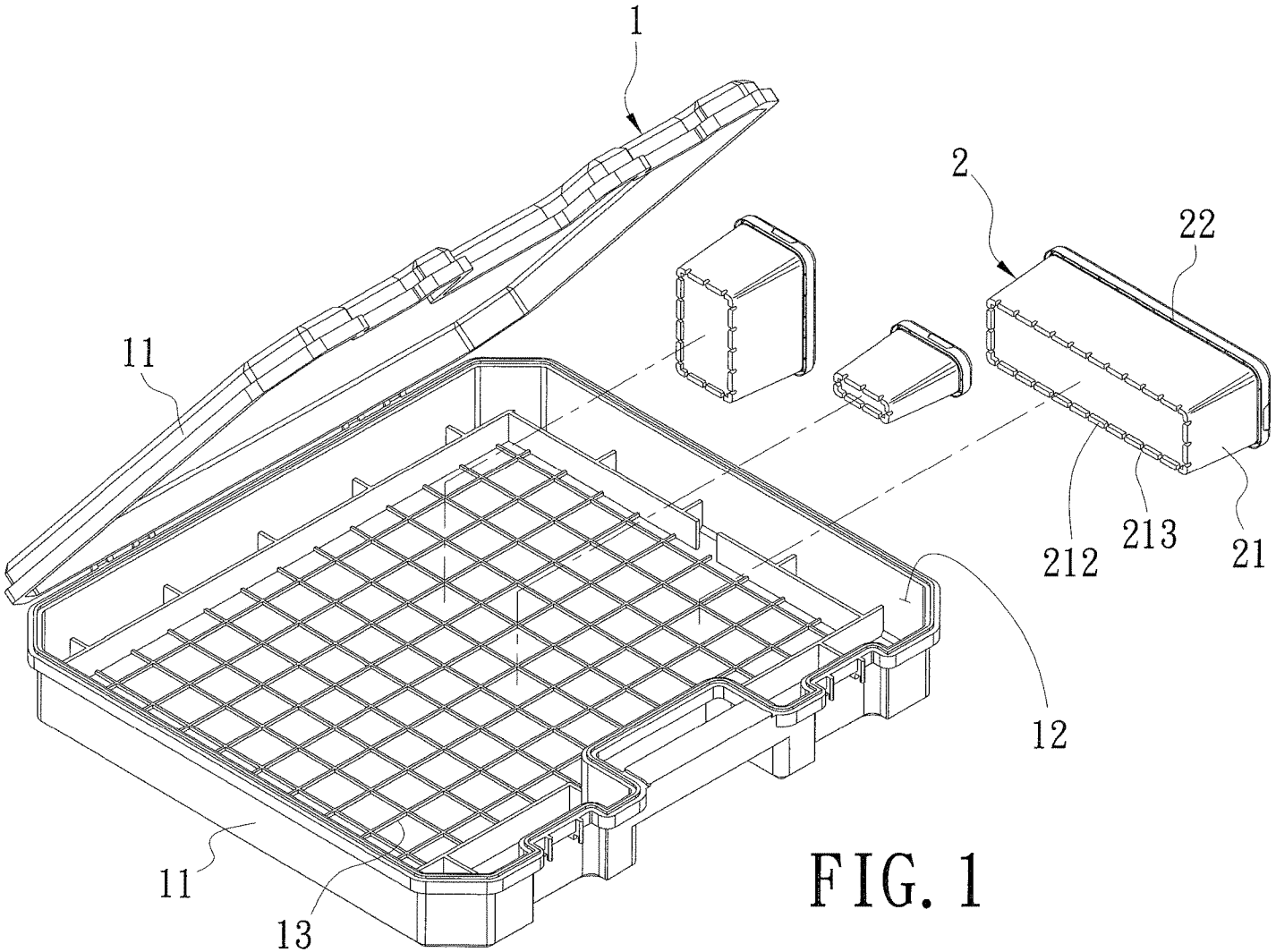
FIG. 1 is a three-dimensional exploded view of a toolbox according to an embodiment of the present invention.

Please refer to FIG. 1, which is a three-dimensional exploded view of a toolbox according to an embodiment of the present invention. A toolbox comprises a case 1 and several containers 2.

The case 1 comprises two shells 11 pivotally connected with each other at one side to form a space inside. An inner bottom of a cavity 12 of one of the two shells 11 formed with several strips 13 which are crossed at right angles. The intervals between two adjacent strips 13 are equal.

The containers 2 have different size, which are put in the space formed by the two shells 11 of the case 1. Each container 2 comprises a body 21, a lid 22 covered an opening of a cavity 211 of the body 21 (shown as FIG. 3), a rib 212 surrounded around a bottom edge of the body 21, and several notches 213 formed in the rib 212 under equal interval to engage with the strips 13 at the inner bottom of the cavity 12 of one of the two shells 11 for positioning the container 2. Furthermore, a top surface of the lid 22 is formed with an indentation 221, and several pegs 222 are formed at sidewalls of the indentation 221 in an equal interval, thereby stacking the body 21 at the indentation 221 in the lid 22, and the pegs 222 at the indentation 221 of the lid 22 are engaged with the notches 213 at the bottom of the body 21.

Figure 2:
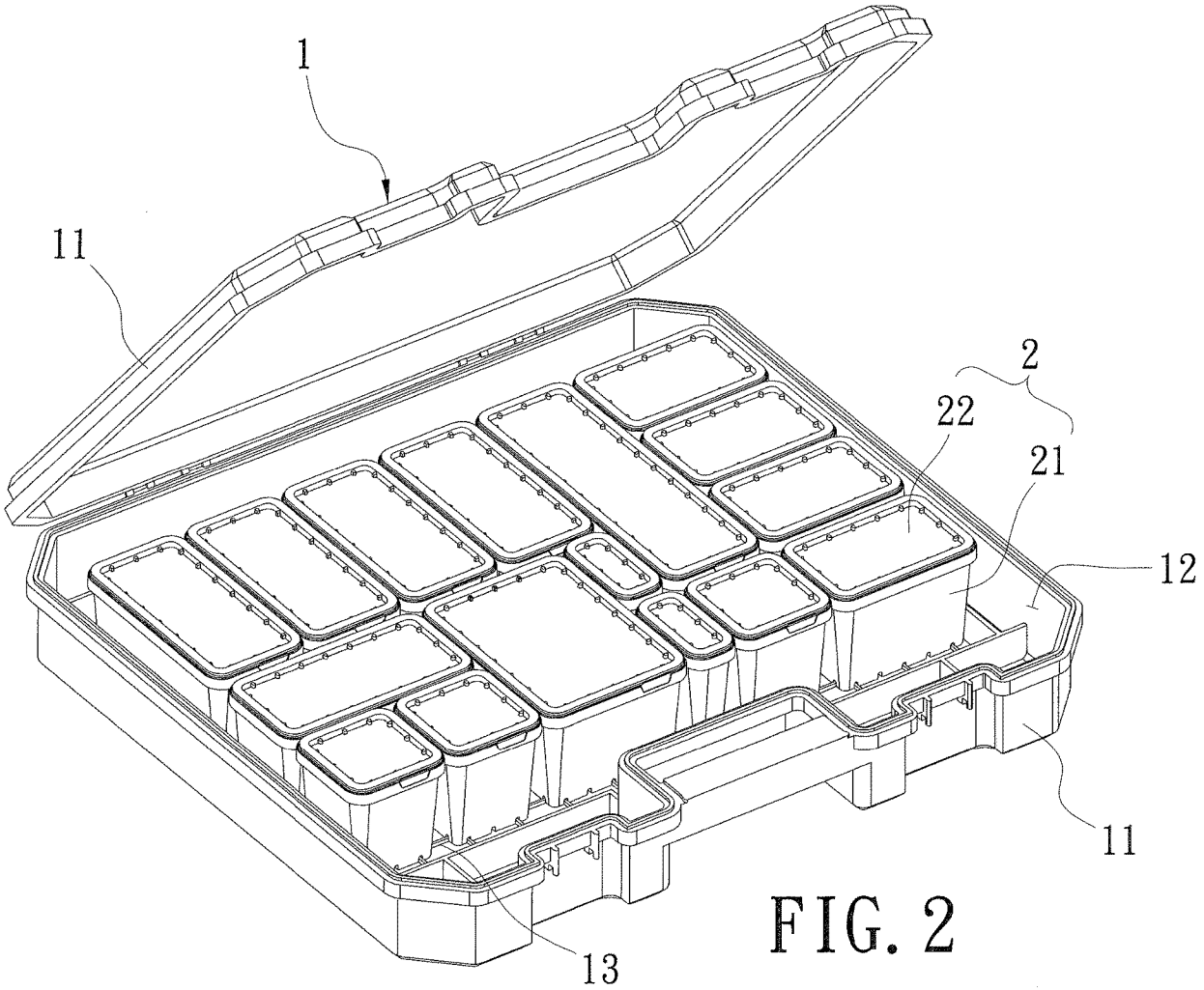
FIG. 2 is a three-dimensional perspective of the containers put in the case according to an embodiment of the present invention.

Please refer to FIG. 2. Accordingly, when the toolbox of the present invention is used, the screws, the nuts, the iron nails, and the rivets are put in the cavity 211 of the body 21 of the different container 2 individually, then, the lid 22 is covered on the opening of the cavity 211 of the body 21, thereby storing the different components in the different containers 2. Next, the containers 2 are put in the cavity 12 of one of the two shells 11, in which the notches 213 at the bottom of the body 21 of the container 2 are engaged with the strips 13 at the bottom of the shell 11, thereby stably positioning the containers 2 inside. Then, the two shells 11 are corresponded to pair together for close. Therefore, when the toolbox of the present invention is carried, it avoids the containers moving to collide with each other in the toolbox due to the engagement of the notches 213 at the bottom of the body 21 of the container 2 and the strips 13 at the bottom of the cavity 12 of the shell 11.

Figure 3:
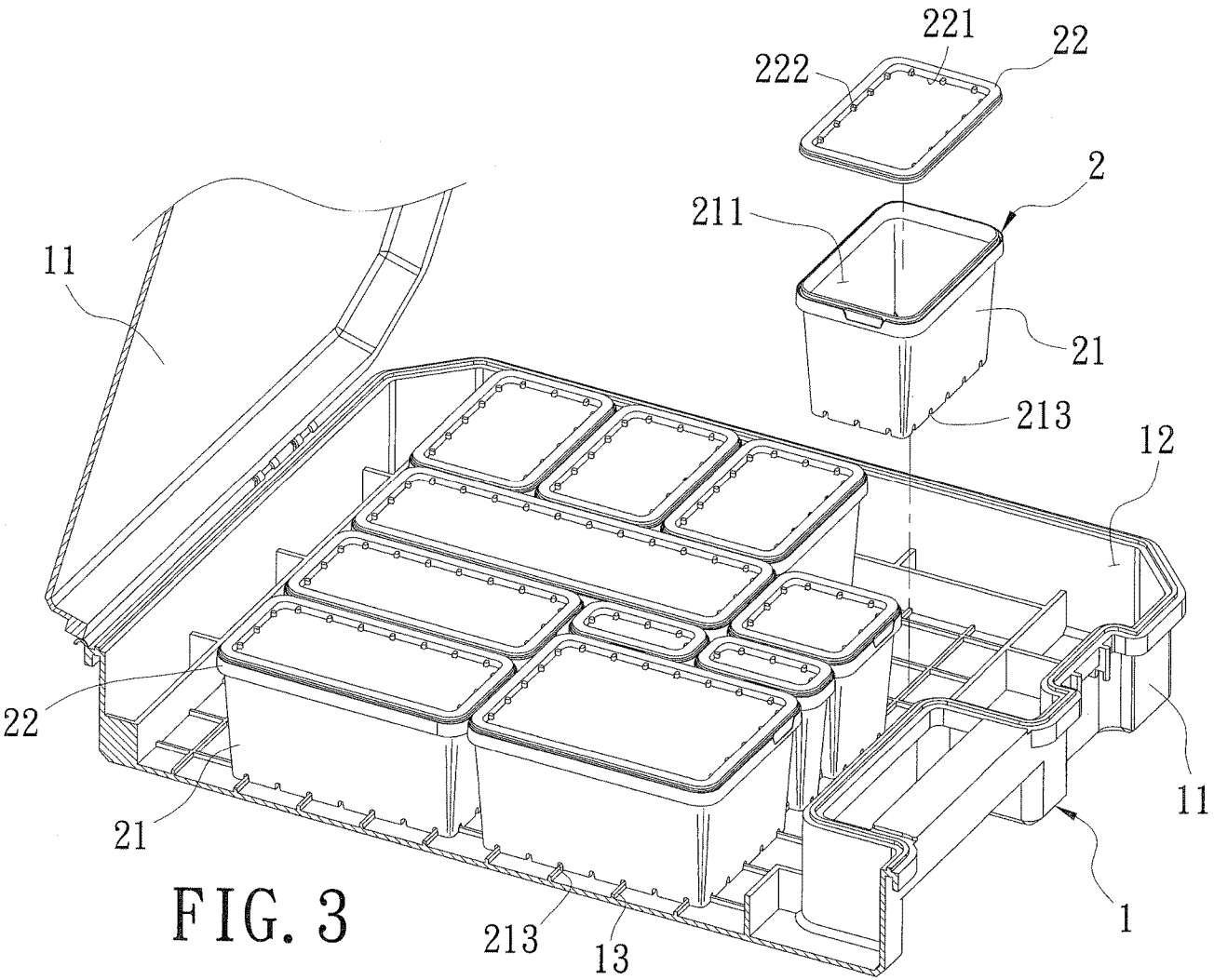
FIG. 3 is a sectional view of the containers in use condition according to an embodiment of the present invention.
Figure 4:
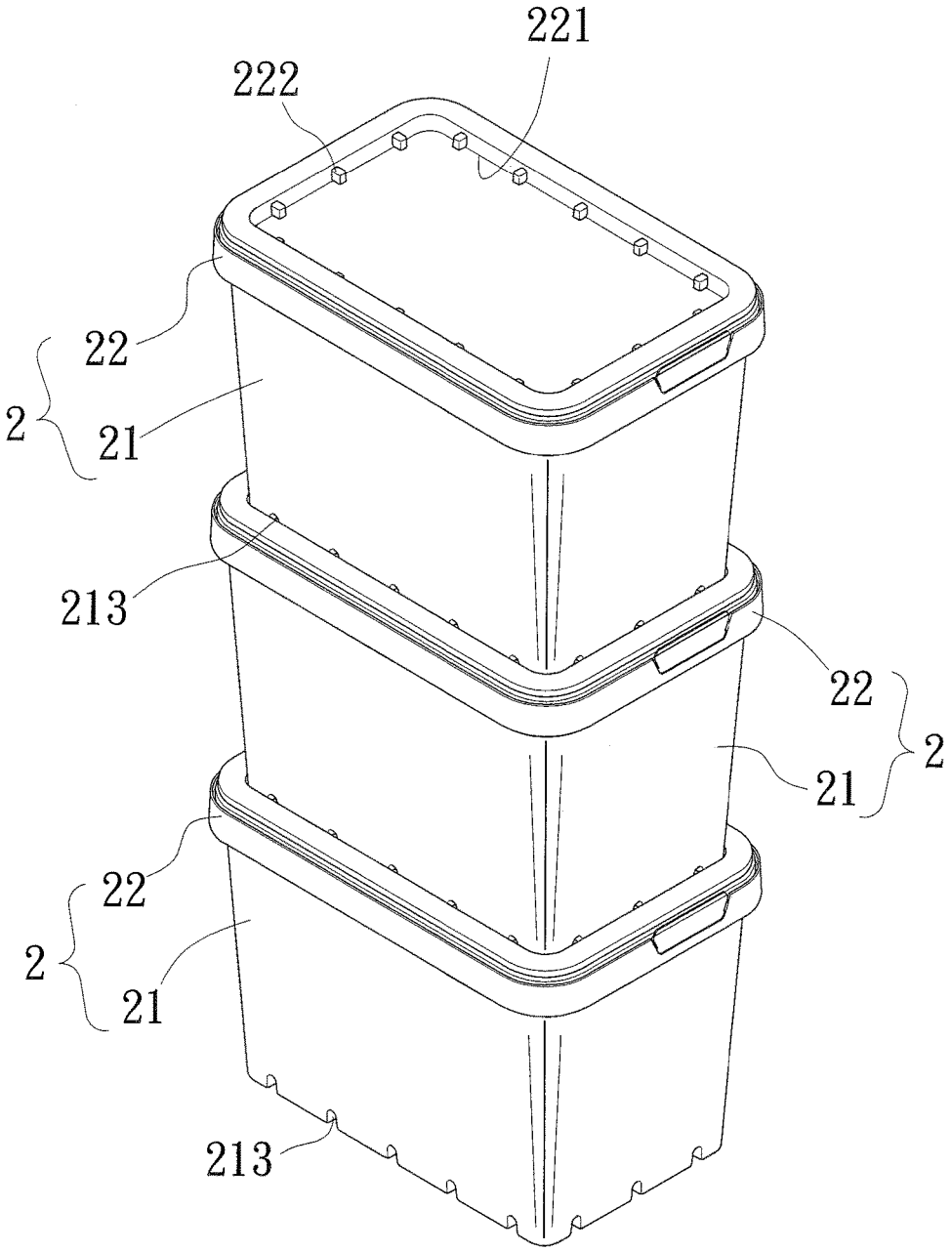
FIG. 4 is a three-dimensional perspective of the containers in stacked condition according to an embodiment of the present invention.

Please refer to FIG. 3 and FIG. 4. Furthermore, when the user works, the two shells corresponded to pair together are opened, and the container 2, which stores the necessary components, is taken out and stacked on the lid 22 of the other container (the lower container) 2, thereby raising the container 2, in which the necessary components are storied, for convenient to take components after the lid 22 of the raised container 2 is opened. The stacked container 2, which is put on the lid 22 of the lower container 2, is stopped by the indentation 221 in the top surface of the lid 22 of the lower container 2, so the stacked container 2 is put stably on the lid 22 without dropping from the top surface of the lid 22. Furthermore, the pegs 222 formed at the sidewalls of the indentation 221 in the lid 22 are engaged with the notches 213 at the bottom of the body 21 of the container 2, further stably positioning the stacked container 2 to prevent that when the components inside is taken out, the stacked container 2 tipping over.

Figure 5:
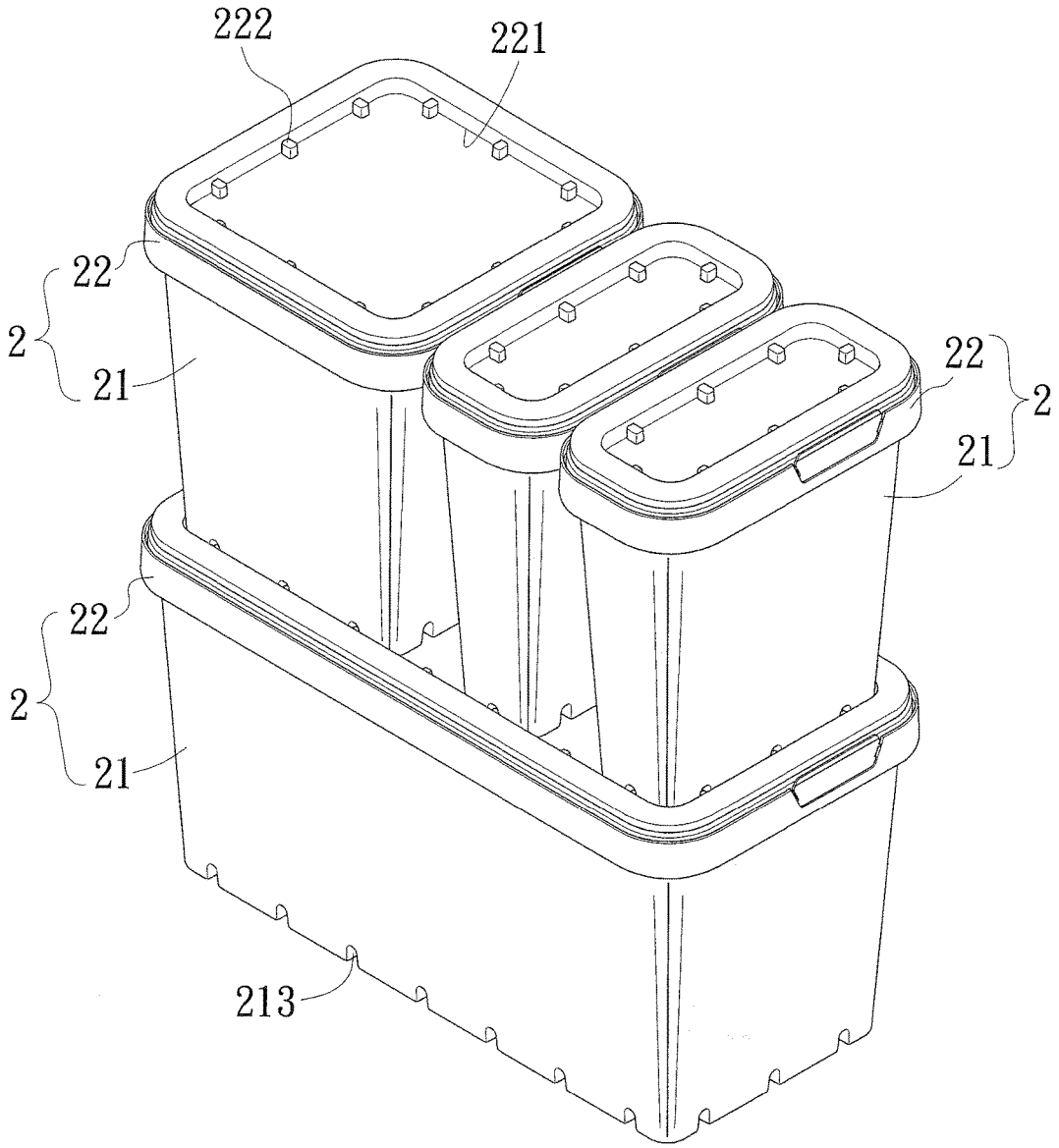
FIG. 5 is a three-dimensional perspective of the containers in stacked condition according to another embodiment of the present invention.

Please refer to FIG. 5, according the area size of the indentation 221 in the top surface of the lid 22 of the lower container 2, more than one containers 2 can be put in the indentation 221 in the top surface of the lid 22 of the lower container 2, the pegs 222 formed at the sidewalls of the indentation 221 in the lid 22 are engaged with the notches 213 at the bottom of the body 21 of the each stacked container 2, thereby advancing the convenience of stacking several containers 2.

According to the above description and embodiments, comparison with the existing structure of the toolbox, the toolbox of the present invention has the advantage as following:

1. In the toolbox of the present invention, one of the two shells is formed with several strips which are crossed at right angles in its cavity bottom, and the body bottom of the container is formed with several notches for engaging with the strips of the shell. With the design of the engagement of the strips, which are crossed at right angles, and the notches at the bottom of the body of the container, the container can be randomly put on any position, which all is corresponded to the strips, increasing the convenience for positioning the containers.

2. In the toolbox of the present invention, the top surface of the lid of the container is formed with an indentation, and several pegs are formed at sidewalls of the indentation, so when one container is stacked on the other container, the bottom of the body of the stacked container is put in the indentation of the lid of the lower container, making the notches at the bottom of the stacked container engage with the pegs at the sidewalls of the indentation in the top surface of the lid of the lower container, thereby increasing the stability of the containers in the stacked condition.

What is claimed is:

1. A toolbox, comprising:

a case including two shells pivotally connected with each other at one side to form a space inside, and one of the two shells defining a cavity over an inner bottom surface and formed with a plurality of strips extending along the inner bottom surface crossed at right angles; and a plurality of containers disposed in removable manner in the space formed by the two shells, each container including:

a body;

a lid covering an opening of the body;

a rib formed along a bottom edge of the body; and a plurality of notches formed in the rib to engage the strips at the inner bottom surface of the cavity of one of the two shells for positioning the container;

wherein at least one container is stackable over one other container in laterally locked engagement.

2. The toolbox according to claim 1, wherein a top surface of the lid of each container is formed with an indentation, and a plurality of pegs are formed at sidewalls of the indentation, wherein when one of the containers is placed within the indentation in the top surface of the lid of another one of the containers, the pegs at the lid of the lower container engage the notches in a bottom edge of the upper container.

* * * * *